United States Patent [19]

Suzuki

[11] Patent Number: 4,672,875

[45] Date of Patent: Jun. 16, 1987

[54] WAVESHAPE MEMORY FOR AN ELECTRONIC MUSICAL INSTRUMENT

[75] Inventor: Hideo Suzuki, Hamamatsu, Japan

[73] Assignee: Nippon Gakki Seizo Kabushiki Kaisha, Hamamatsu, Japan

[21] Appl. No.: 650,910

[22] Filed: Sep. 13, 1984

[30] Foreign Application Priority Data

Sep. 14, 1983 [JP] Japan ..... 58-168358

[51] Int. Cl.[4] ..... G10H 7/00

[52] U.S. Cl. ..... 84/1.01; 84/1.19

[58] Field of Search ..... 84/1.01, 1.19, 1.13, 84/1.26

[56] References Cited

U.S. PATENT DOCUMENTS 4,269,101 5/1981 Deutsch et al. ..... 84/1.01

4,383,462 5/1983 Nagai et al. ..... 84/1.26

4,442,745 4/1984 Gross et al. ..... 84/1.01

*Primary Examiner*—S. J. Witkowski

*Assistant Examiner*—David Warren

*Attorney, Agent, or Firm*—Spensley Horn Jubas & Lubitz

[57] ABSTRACT

Data for each sample point amplitude values of a desired waveshape is expressed in mantissa and exponent in accordance with a floating-point representation. The desired waveshape is divided into a plurality of frames along a time axis and the exponent data is common in each individual one of said frames which includes a plurality of sample points. The number of the frames is much smaller than the number of all sample points. In this waveshape memory, the mantissa data corresponding to the respective sample points are stored in a first memory, and exponent data corresponding to the respective frames are stored in a second memory.

12 Claims, 6 Drawing Figures

| SAMPLE POINT ADDRESS | MANTISSA DATA |
|---|---|
| 0 | $M_0$ |
| 1 | $M_1$ |
| 2 | $M_2$ |
| ⋮ | ⋮ |
| G | Mg |
| G+1 | Mg+1 |
| ⋮ | ⋮ |
| H | Mh |
| H+1 | Mh+1 |
| ⋮ | ⋮ |
| I | Mi |
| I+1 | Mi+1 |
| ⋮ | ⋮ |
| J | Mj |
| J+1 | Mj+1 |
| ⋮ | ⋮ |
| K | Mk |
| K+1 | Mk+1 |
| ⋮ | ⋮ |
| L | $M_L$ |
| L+1 | $M_L$+1 |
| ⋮ | ⋮ |
| M | Mm |
| M 1 | Mm+1 |
| ⋮ | ⋮ |
| N | Mn |

| FRAME ADDRESS | EXPO-NENT DATA | SAMPLE POINT ADDRESS RANGE DATA |
|---|---|---|
| 0 | 7 | G |
| 1 | 6 | H |
| 2 | 5 | I |
| 3 | 4 | J |
| 4 | 3 | K |
| 5 | 2 | L |
| 6 | 1 | M |
| 7 | 0 | N |

WAVESHAPE MEMORY FOR AN ELECTRONIC MUSICAL INSTRUMENT

BACKGROUND OF THE INVENTION

This invention relates to a waveshape memory to be employed for an electronic musical instrument and other tone generation devices and, more particularly, to a waveshape memory storing waveshape data in a compressed form of representation and thereby enabling reduction in the required memory capacity.

In a prior art waveshape memory for an electronic musical instrument, waveshape data is stored directly in linear or logarithmic representation format. This requires a large bit number resulting in increase in the memory capacity. If, particularly, waveshape data for one sample point is of a large bit number in a case where a tone waveshape signal of a high quality equivalent to a tone of a natural musical instrument is to be obtained by storing a full waveshape or a waveshape of plural periods from the start to the end of generation of a tone in a memory and reading the waveshape from this memory, the memory capacity as a whole becomes extremely large. An attempt to reduce the bit number of data for one sample point tends to reduce the dynamic range thereby impairing the tone quality of the tone produced.

An electronic musical instrument of a type in which, in the above described manner, a full waveshape from the start to the end of generation of a tone is prestored for each key (note) in linear representation format and this waveshape is read out is disclosed in the specification of U.S. Pat. No. 4,383,462. In the waveshape memory WM31 shown in FIG. 3 of this U.S. patent, the full waveshape is stored in linear representation format and this full waveshape is read out in response to a signal KD which represents a key depression timing.

While there is no prior art of a memory in which a full waveshape is stored in a logarithmic representation format, storing of a full waveshape in a logarithmic representation format will be naturally conceived, for there is a well known art of storing a waveshape of one period in a logarithmic representation format and thereby simplifying an operation circuit in utilizing an output read-out signal for multiplication and division.

SUMMARY OF THE INVENTION

It is, therefore, an object of the invention to provide a waveshape memory capable of storing waveshape data in a data representation format according to which a sufficient dynamic range can be obtained with a relatively small bit number and thereby reducing the memory capacity without imparing the dynamic range of a waveshape signal.

The first feature of the invention is to represent data concerning an amplitude value at each sample point of a desired waveshape in a floating-point representation consisting of mantissa (or fixed-point part) and exponent and store mantissa data and exponent data separately in a memory. This arrangement enables reduction of the bit number per one sample point to a great extent while securing a sufficient dynamic range.

The second feature of the invention resides in that not only data is expressed in the floating-point representation but that the desired waveshape is divided into a plurality of frames along the time axis (i.e., time frame the number of which is much smaller than the total number of sample points) and each of such frames contains common exponent data and the mantissa data is stored in addresses corresponding to respective sample points whereas the exponent data is stored in addresses corresponding to respective frames. This construction obviates the requirement for a large number of addresses corresponding to the respective sample points and only requires provision of a small number of addresses for the respective frames thereby contributing to reduction of the memory capacity of the waveshape memory as a whole. The waveshape memory according to the invention is applicable not only to an electronic musical instrument but to any other purposes.

According to the present invention, the bit number of waveshape data for one sample point can be reduced to a large extent and yet a sufficient dynamic range can be secured whereby waveshape data of a high quality can be stored by a relatively small and economical memory. The division of the waveshape into mantissa and exponent can simplify the construction of a level coefficient operation circuit (i.e., reducing the operation bit number). Further, since a D/A converter of a type in which a digital data of a small bit number consisting of mantissa and exponent can be used as a D/A converter for converting digital data read out from the memory to analog data, the circuit construction of the D/A converter can be simplified and it can be manufactured at a lower cost.

DESCRIPTION OF PREFERRED EMBODIMENTS

Figures 1, 2A, 2B:
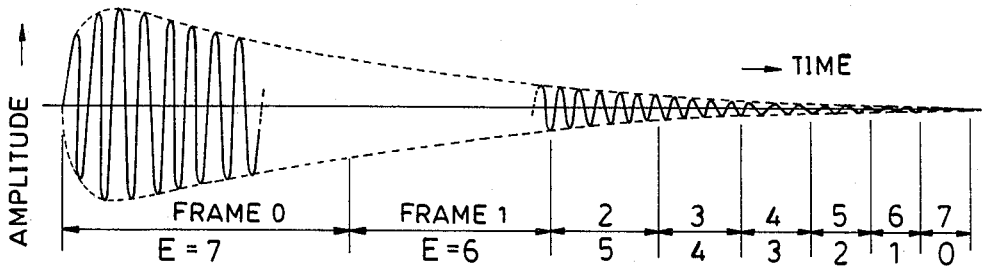
FIG. 1 is a waveshape diagram showing a waveshape of plural periods over a full tone generation period as an example of object of storage in the waveshape memory according to the invention, the diagram illustrating the manner of dividing the waveshape into frames and an example of exponent data corresponding to the frames.
FIGS. 2*a* and 2*b* are diagrams showing examples of memory format in the waveshape memory according to the invention.

Storing of a tone waveshape of plural periods from the start to the end of generation of a tone will be described first. FIG. 1 shows a example of such tone waveshape over a full tone generation period. The full section of this tone waveshape is divided into a multiplicity of sample points in the known manner and amplitude values at the respective sample points are taken. Digital values $A_i$ of the amplitudes at the respective sample points are expressed in the floating-point representation $A_i = M \cdot B^E$ where M represents mantissa, E exponent and B base. In the binary representation, base B generally is B=2 so that the sample point amplitude value $A_i$ can be identified by the mantissa M and exponent E. The full section of this tone waveshape is divided into plural frames along the time axis (the number of frames is much smaller than the total number of sample points, e.g. 8 as in the example of FIG. 1) and divisions of data into the frames and the floating-point representation are made in such a manner that the value of the exponent data becomes common within each individual frame. In the example of FIG. 1, values of exponent E corresponding to the frame 0, 1, 2, 3, 4, 5, 6 and 7 are "7", "6", "5", "4", "3", "2", "1" and "0" respectively.

With respect to the mantissa data and exponent data of the sample point amplitude values thus established, the waveshape memory is constituted by storing the mantissa data at sample point addresses corresponding to the respective sample points and the exponent data at the frame addresses corresponding to the respective frames. Examples of memory formats of this waveshape memory are shown in FIGS. 2*a* and 2*b*. FIG. 2*a* shows a format of the sample point address and FIG. 2*b* a format of the frame address. At sample point addresses 0 to G corresponding to the frame 0 is stored mantissa data $M_0$-$M_g$ corresponding to the respective sample points in the frame 0. At sample point addresses G+1 to H corresponding to the frame 1 is stored mantissa data Mg+1 to $M_h$ corresponding to the respective sample point of the frame 1. At subsequent sample point addresses H+1 to I, I+1 to J, J+1 to K, K+1 to L, L+1 to M and M+1 to N corresponding to the frames 2 to 7 are stored, as illustrated, mantissa data $M_{h+1}$ to $M_n$ corresponding to the respective sample points. G to N are any integers satisfying the relationship G<H<I<J<K<L<M<N and "N+1" corresponds to the total number of sample points. As shown in FIG. 2*b*, at frame addresses 0 to 7 corresponding to the frames 0 to 7, exponent data E=7 to 0 corresponding to the respective frames is respectively stored. In this embodiment, data for identifying the range of the sample point addresses corresponding to the respective frames is stored at the respective frame addresses. The sample point address range data, for example, are data indicating the last sample point addresses G, H, I, J, K, L, M and N in the respective frames.

Figure 3:
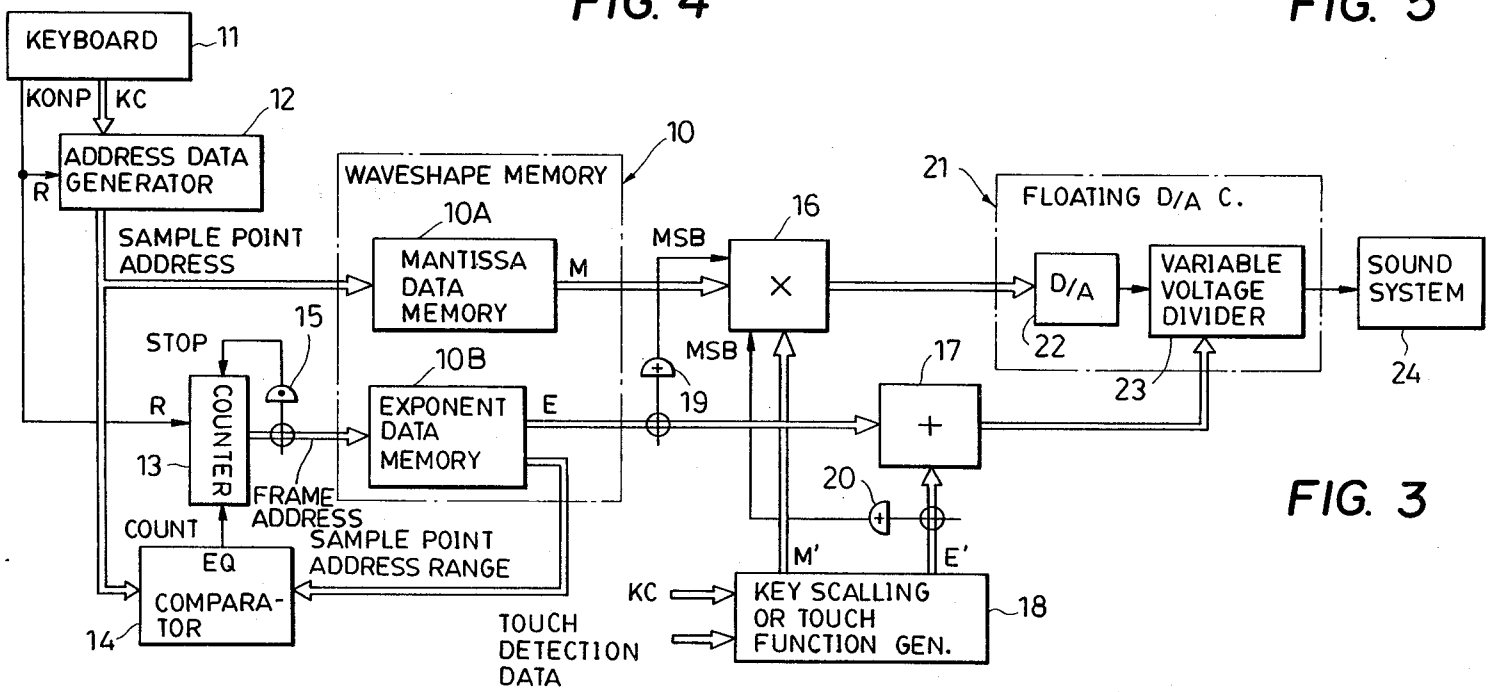
FIG. 3 is an electrical block diagram showing an example of an electronic musical instrument incorporating the waveshape memory as a tone waveshape memory.

FIG. 3 shows an example of an electronic musical instrument employing a waveshape memory 10 according to the present invention. The waveshape memory 10 consists of a mantissa data memory 10A and an exponent data memory 10B. In the mantissa data memory 10A, the mantissa data M corresponding to the respective sample points are stored at the respective sample point addresses 0 to M as shown in FIG. 2*a* whereas in the exponent data memory 10B, the exponent data E=7 to 0 corresponding to the respective frames and the sample point address range data are stored at the respective frame addresses 0 to 7.

As means for designating the tone pitch of a tone to be generated, a keyboard 11 is used. Information (key code KC) representing a key depressed in the keyboard 11 is supplied to an address data generator 12. The address data generator 12 constitutes means for reading out waveshape data from the waveshape memory 10 in response to the tone pitch designated by the keyboard 11, particularly generating sample point address data sequentially changing at a rate corresponding to the designated tone pitch. The sample point address data generated by this address data generator 12 is supplied to the address input of the mantissa data memory 10A to sequentially read out the mantissa data $M_0$ to $M_n$ corresponding to the respective sample point addresses 0 to N stored at these addresses. The address data generator 12 is adapted to be reset to its initial address (i.e., the sample point address 0) by a key-on pulse KONP which is generated immediately upon depression of the key in the keyboard 11. Any known technique may be used for generating the address data in the address generator 12 so that detailed description thereof will be omitted.

A counter 13 and a comparator 14 are provided for generating the frame address data. Count output of the counter 13 is applied to the address input of the exponent data memory 10B as the frame address data to sequentially read out the exponent data E=7 to 0 corresponding to the frame addresses 0 to 7 and the sample point address range data (last address data) stored at these addresses. The sample point address range data read out from the memory 10B is applied to one input of the comparator 14 while the sample point address data from the address data generator 12 is applied to another input of the comparator 14. The comparator 14 generates a signal "1" from its coincidence output EQ when the two inputs coincide with each other and this signal is applied to the count input of the counter 13. The counter 13 is reset to the initial address "0" by the key-on pulse KONP at the start of the tone generation. Accordingly, the exponent data E=7 and the sample point address range data G corresponding to the frame 0 are initially read out from the frame address 0 of the memory 10B. As the sample point address changes sequentially from 0 to 1, 2, 3, . . . and becomes the last sample point address G in the frame 0, the comparator 14 produces the signal "1" and the counter thereby is counted up by 1 count. Thus the frame address data changes to "1" and data corresponding to the frame 1 is read out from the memory 10B while the contents of the counter 13 are not changed until the sample point address reaches the last address H in the frame 1. In the foregoing manner, the contents of the counter 13 do not change while the sample point address data generated by the address data generator 12 remains in the same frame and the frame address data corresponding to this frame is produced. Each time the frame to which the sample point address data belongs changes, the frame data also changes. Accordingly, actual data of the waveshape amplitude values can be identified by combinations of the mantissa data M ($M_0$ to $M_h$) at the respective sample points read out from the mantissa data memory 10A and the exponent data E (7 to 0) simultaneously read out from the exponent data memory 10B. When the count output of the counter 13 has become the maximum value "7", an AND gate 15 is enabled thereby stopping the counting operation of the counter 13.

The mantissa data M and the exponent data E read out from the memories 10A and 10B are respectively applied to level controlling multiplier 16 and adder 17. A key scaling or touch function generator 18 generates level coefficient data for key scaling in accordance with a predetermined key scaling function using the key code KC of the depressed key as a parameter. The generator 18 generates this level coefficient data in the floating-point representation consisting of mantissa data M' and exponent data E'. The multiplier 16 multiplies the mantissa data M and M' together and the adder 17 adds the exponent data E and E' together (the addition of the exponents E and E' is substantially equivalent to the multiplication of $2^E$ and $2^{E'}$).

As will be seen from the following Table 1, the progression of the mantissa data M exhibits continuity from the maximum value 1111 . . . (all "1") to the minimum value 0000 . . . (all "0") in correspondence to respective values of the exponent data E but it is not continuous between different values of exponent data E. More specifically, although the mantissa data M when the exponent data E is "0" corresponds directly to the actual value, the mantissa data M when the exponent data E is other than "0" does not correspond to the actual value but data constituted by adding "1" to a higher bit of the mantissa data M corresponds to the actual value. By this arrangement, the continuity of the progression of the mantissa data M between the different values of exponent data E can be maintained.

Accordingly, in the example of FIG. 3, all bits of the exponent data E read out from the memory 10B are applied to an OR gate 19 and a signal "1" is produced from the OR gate 19 is $E \neq 0$. This signal "1" is added to the mantissa data M read out from the memory 10A as data corresponding to the most significant bit MSB and the resulting data is applied to the multiplier 16. Similarly, all bits of the exponent data E' of the level coefficient are applied to an OR gate 20, a signal "1" is produced from the OR gate 20 if $E \neq 0$, this signal "1" is added to the mantissa data M' of the level coefficient as data corresponding to the most significant bit MSB and the resulting data is applied to the multiplier 16.

TABLE 1

| Exponent data E | Mantissa data M | Data constituted by adding "1" to a higher bit of M when $E \neq 0$ |
|---|---|---|
| 111 | 1111 . . . | 11111 . . . |
| | ~ | ~ |
| | 0000 . . . | 10000 . . . |
| 110 | 1111 . . . | 011111 . . . |
| | ~ | ~ |
| | 0000 . . . | 010000 . . . |
| 101 | 1111 . . . | 0011111 . . . |
| | ~ | ~ |
| | 0000 . . . | 0010000 . . . |
| . | . | . |
| . | . | . |
| . | . | . |
| 001 | 1111 . . . | 000 . . . 011111 . . . |
| | ~ | ~ |
| | 0000 . . . | 000 . . . 010000 . . . |
| 000 | 1111 . . . | 000 . . . 001111 . . . |
| | ~ | ~ |
| | 0000 . . . | 000 . . . 000000 . . . |

The mantissa data produced by the multiplier 16 and the exponent data produced by the adder 17 are applied to a floating digital-to-analog converter 21 where these data are converted from the floating-point representation to the actual value of the sample point amplitude values and also converted to analog data. This floating digital-to-analog converter 21 comprises a digital-to-analog converter 22 for converting the mantissa data to an analog signal and a variable voltage-divider 23 which voltage-divides (level-shifts) the analog voltage of the converted mantissa data at a ratio corresponding to the value of the exponent data. In the variable voltage-divider 23, the voltage-dividing ratio is so set that it is $2^0=1$ if the exponent data value E is the maximum value "7" when the base B is "2", it is $2^{-1}=\frac{1}{2}$ if $E=6$, it is $\frac{1}{4}$ if $E=5$, it is $\frac{1}{8}$ if $E=4$, it is 1/16 if $E=3$, it is 1/32 if $E=2$, it is 1/64 if $E=1$ and it is 1/128 if $E=0$. The mantissa data in the floating-point representation is thus converted to the actual value. The output of the floating digital-to-analog converter 21 is finally supplied to a sound system 24.

Figure 4:
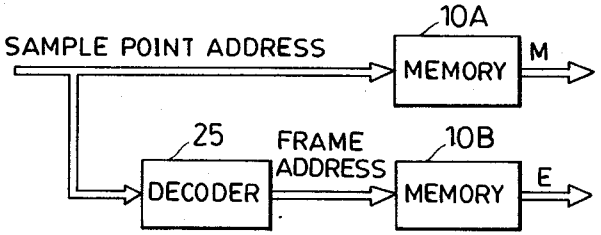
FIG. 4 is a block diagram showing a modified example of a portion relating to generation of frame address data shown in FIG. 3.

In the above described embodiment, the exponent data memory 10B stores the sample point address range data as shown in FIG. 2*b* in correspondence to the respective frame addresses. The memory 10B may store only the exponent data without storing the sample point address range data. In that case, the circuit for accessing the exponent data memory 10B may be modified to a circuit shown in FIG. 4 so that the frame address data may be generated by decoding the sample point address data by a frame address decoder 25 in accordance with a predetermined decoding logic.

Figure 5:
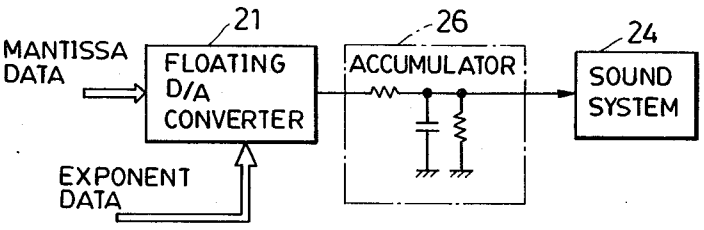
FIG. 5 is a block diagram showing a modified example of a portion of FIG. 3 in a case where a difference value between amplitudes of adjacent sample points is stored in the waveshape memory.

In the above described embodiment, the sample point amplitude values themselves of the desired waveshape are represented by the floating-point representation and stored in the waveshape memory 10. The invention, however, is not limited to this, but difference values between adjacent sample point amplitudes values (with a positive or negative sign) may be represented in the floating-point representation and stored in the waveshape memory 10. This construction will enable further reduction in the bit number or further expansion in the dynamic range. Since it is necessary in this case to finally obtain the respective sample point amplitude values by cumulatively adding or subtracting the difference value data of the respective sample points, an analog accumulator 26 may be provided in the posterior stage of the floating digital-to-analog converter 21 as shown in FIG. 5 for cumulatively adding or subtracting the analog data for the difference values.

In the above described embodiment, data for the respective sample point amplitude values of the tone waveshape over the full tone generation period (amplitude values themselves or difference values) is stored in the waveshape memory 10. Alternatively, data for a waveshape of one period or any plural periods may be stored in the floating-point representation. In this case, for realizing repeated generation of the frame address, the control for stopping the counter 13 by the AND gate 15 (FIG. 3) is not performed. Alternatively, data of the full waveshape of the rising portion of the tone and a partial waveshape of a subsequent waveshape (waveshape of plural periods) may be stored in the floating-point representation.

The waveshape memory according to the invention is applicable not only to the above described tone waveshape but also to other desired waveshape including an envelope shape. In that case, a memory format and a reading system which are substantially the same as those in the above described embodiment may be employed.

What is claimed is:

1. A waveshape memory characterized in that data stored therein represents sample point amplitude values corresponding to sample points of a waveshape to be produced and expressed as mantissa data and exponent data in accordance with a floating-point representation, said waveshape is divided into a plurality of frame along a time axis, wherein all mantissa data in an individual frame have a common exponent data associated therewith and adjacent frames have different exponent data associated therewith, said mantissa data are stored in a first memory, said first memory respectively storing eacch mantissa data associated with each one of said sample points in a different memory location, and said common exponent data are stored in a second memory, said second memory storing only one common exponent data for each frame, thereby reducing memory size requirement for storing said sample point amplitude values.

2. A waveshape memory as defined in claim 1 further comprising:

sample point address generation means for generating a sample point address signal for sequentially designating said sample points and supplying said sample point address signal to an address input of said first memory; and frame address generation means for generating a frame address signal for sequentially designating said frames and supplying said frame address signal to an address input of said second memory.

3. A waveshape memory as defined in claim 2 further comprising conversion means for operating said mantissa data read out from said first memory and said exponent data read out from said second memory and outputting actual data directly representing said sample point amplitude values.

4. A waveshape memory as defined in claim 3 wherein said conversion means comprises a digital-to-analog converter for converting said mantissa data read out from said first memory to an analog mantissa data signal and scaling means for scaling an amplitude of said analog mantissa data signal in accordance with the value of said exponent data read out from said second memory, said conversion means providing said actual data in an analog waveshape signal.

5. A waveshape memory as defined in claim 2 wherein said frame address generation means consists of a decoder which generates said frame address signal in accordance with the range of sample point addresses represented by said sample point address signal.

6. A waveshape memory as defined in claim 1 wherein said second memory further stores sample point address range specifying data specifying the range of sample point addresses belonging to each of said frames and outputs said exponent data and said sample point address range specifying data together in response to said frame address signal, and said frame address generation means includes comparator means for comparing said sample point address signal with said sample point address range specifying data and counter means for causing the frame address signal to step each time a specified sample point address range has been completed.

7. A waveshape memory as defined in claim 1 wherein said waveshape is a musical tone waveshape consisting of plural periods.

8. A waveshape memory as defined in claim 1 wherein said waveshape is an envelope waveshape of a musical tone.

9. A waveshape memory as defined in claim 1 wherein a difference value between amplitude values of neighboring ones of said sample points of said waveshape is expressed in said mantissa and said exponent.

10. A waveshape memory device according to claim 1 further comprising combining means for combining said mantissa data stored in said first memory with its associated common exponent data stored in said second memory to thereby generate floating-point data representing a desired amplitude value.

11. In an electrical musical instrument of the type wherein a complete musical waveshape is stored as sample points in a memory and read out to produce a musical tone, the waveshape sample points each being represented by a floating point number having a mantissa value and an exponent value, the improvement for memory size reduction wherein:

the mantissa value of every sample point is stored in a separate memory location, and wherein for each group of sequential sample point values having the same exponent value, only one exponent value is stored, wherein each exponent value is stored in a separate memory location.

12. In an electrical musical instrument of the type wherein a complete musical waveshape is stored as sample points in a memory and read out to produce a musical tone, the waveshape sample points each being represented by a floating point number having a mantissa value and an exponent value, the improvement for memory sizee reduction wherein:

the mantissa value of every sample point is stored in a separate memory location, and wherein for each group of sample point value having the same exponent, the exponent value is stored only once, wherein each exponent value is stored in a separate memory location.

* * * * *